United States Patent [19]

Suzuki et al.

[11] 4,316,475

[45] Feb. 23, 1982

[54] TOBACCO SMOKE FILTER PLUG AND PRODUCING METHOD THEREFOR

[75] Inventors: Migaku Suzuki, Kawanoe; Takashi Sakai, Toyoma, both of Japan

[73] Assignees: Mitsubishi Rayon Co.; Mitsubishi Adetate Co., both of Tokyo, Japan

[21] Appl. No.: 137,267

[22] Filed: Apr. 4, 1980

[30] Foreign Application Priority Data

Apr. 12, 1979 [JP] Japan ..... 54-44647

[51] Int. Cl.[3] ..... A24C 5/50

[52] U.S. Cl. ..... 131/340

[58] Field of Search ..... 131/261 R–269, 131/340, 339, 331

[56] References Cited

U.S. PATENT DOCUMENTS 2,916,038 12/1959 Wade ..... 131/340

3,094,450 6/1963 Davidson ..... 131/340

3,226,280 12/1965 Muller ..... 131/340

4,197,863 4/1980 Clayton et al. ..... 131/340

*Primary Examiner*—V. Millin

*Attorney, Agent, or Firm*—Oblon, Fisher, Spivak, McClelland & Maier

[57] ABSTRACT

A tobacco smoke filter plug comprises fiber tow fillings in the form of cylinder, composed of an inner core phase and an outer skin layer different from each other in fibrous arrangement structure thereof, the inner core phase consisting of fillings in a folded arrangement structure having a folding axis forming an angle of $\alpha$ with respect to the central longitudinal axis of the filter plug in cross section, and the outer skin layer consisting of fillings in a folded structure substantially parallel to the central longitudinal axis of the filter plug in cross section and surrounding said inner core phase.

8 Claims, 12 Drawing Figures

TOBACCO SMOKE FILTER PLUG AND PRODUCING METHOD THEREFOR

BACKGROUND OF THE INVENTION

1. Field of the Invention

The present invention relates to method and apparatus of producing a tobacco smoke filter having a double structure composed of an inner core phase in a special fibrous arrangement and an outer skin layer in a different fibrous arrangement therefrom, surrounding the core phase. The tobacco smoke filters according to the present invention possess high collapse strengths and physical and chemical characteristics in which the filtration efficiency of tastable component is low whereas the filtration efficiencies of tar and total particlate matter hereinafter referred to as the "TPM" when applicable, which are components harmful on health, contained in tabacco smoke are high. Further, the tobacco smoke filter according to the present invention allows a small amount of bundle of filaments to be used for producing a tobacco smoke filter without a decrease in filtration efficiency thereof.

2. Description of the Prior Art

It is well known, for example, in Japanese Patent Publication No. 39/28539 and unexamined Japanese Patent Application No. 53/47599, that tobacco smoke filter are so constructed that the fibers are folded in the transversal direction as shown in FIG. 3. In smoke filters in such a fibrous arrangement, when the fibers are wound into filter plugs, the fibrous arrangement or structure tends to be misaligned, and it is, therefore, impossible to effectively produce tobacco smoke filters having uniform fibrous fillings and stable configurations. Such a filter tends to bend and is held in smoker's mouth resulting in deformation.

On the other hand, various methods of producing tobacco smoke filters, in which an air jet is used as means for supplying fiber's tow to a plug machine are disclosed, for example, in U.S. Pat. Nos. 3,016,945 and 3,050,430. It is the feature of these tobacco smoke filter producing methods that a tip end of the air jet means is disposed adjacent an end of a tonque, and the filament tow is fed to thereby produce plain filters so as to maintain the crimps formed on a number of filaments of the tow. It is impossible to uniformly fold the fiber's tow in the transversal or crosswise direction to the filter axis by overfeeding the tow from such an air jet into the inner space in the tongue. Therefore, there has been a strong demand for improvements to the coupling manner between the air jet and the tongue of the filter forming machine and to structures of the air jet and the tongue in order to produce a tobacco smoke filter having a specific fibrous arrangement structure and skin core type structure as defined by the present invention.

SUMMARY OF THE INVENTION

Accordingly, in view of the above noted defects an object of the present invention is to provide a plug for tobacco filters which offers a good flavor taste to the smoker. More particularly, this object is achieved by forming a specific fibrous arrangement in a fibrous fillings in the tobacco filter plug.

A primary object of the present invention is to provide a tobacco smoke filter having high filtration efficiencies of TPM, tar and the like contained in the tobacco smokes, which are harmful on the human's health.

Another object of the present invention is to provide a tobacco smoke filter having a filtration efficiency of nicotine which is a flavor tastable component, the removal efficiency of nicotine being not increased in comparison with a general tobacco filter.

Still another object of the present invention is to provide a tobacco filter having a sufficient strength of the filter plug when held in the smoker's mouth, such a strength affecting the smoke feeling to some extent.

Still another object of the present invention is to provide a method of producing a tobacco filter having the above-described characteristics and a novel fibrous arrangement structure. This method will be carried out by using in combination a relatively simple novel air jet device and a filter plug forming device well known in the art.

These and other objects of the present invention are accomplished by providing a novel fibrous arrangement structure in the fibrous fillings in the plug. More specifically, such a structure consists in the longitudinal cross section of the tobacco filter, of an inner core phase A formed of fibrous fillings in a continuous folded arrangement structure at an angle with respect to the longitudinal axis of the tobacco filter, and of an outer skin layer B formed of fibrous fillings in a folded structure substantially parallel to the longitudinal axis of the tabacco filter and surrounding the inner core phase A more than one half round. The inner core A and the outer layer B are different from each other in arrangement of fiber filaments. A fibrous tow having a total denier about 40,000 D or less is fed from the air jet means to the inner hollow space of the filter forming machine tongue to thereby form the fibrous arrangement in a folded structure in a transversal direction to the central axis of the space, and then a sheering stress is applied to the outer periphery of the fibrous arrangement by using the inner surface of the tongue so that the fibrous fillings are folded forming a slant angle to the longitudinal axis of the filter plug in the longitudinal cross section to thereby form the inner core phase according to the present invention. On the other hand, the outer skin layer B is formed of the fibrous fillings folded substantially parallel to the longitudinal axis of the plug. The outer part of the fibrous fillings folded in the transversal direction is drawn backward from the plug machine i.e., in the opposite direction to the feeding direction by utilizing air flow escaping through the tip end portion of air jet means and/or the small holes of the air jet means when the fiber filaments are fed into the filter plug machine. The outer part of filaments in this state is stabilized around the inner core phase A to thereby form the outer layer in accordance with the requirement for the present invention. Therefore, as compared with a prior art plug in which fibrous fillings are only folded in the transveral direction of the plug, a sufficient collapse strength and a uniform fibrous filling density can be obtained and at the same time a high production efficiency can be also obtained according to the present invention.

BRIEF DESCRIPTION OF THE DRAWINGS

The present invention will be described with reference to the accompanying drawings in which.

$$F=-\log(1-E)/L \quad (1)$$

Figure 8:
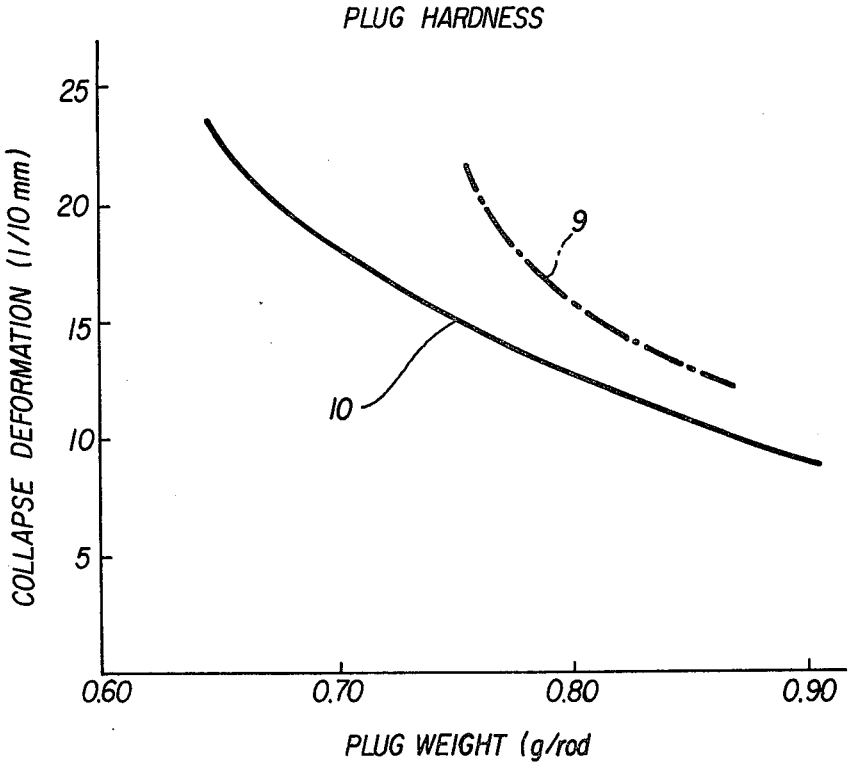
Figure 5:
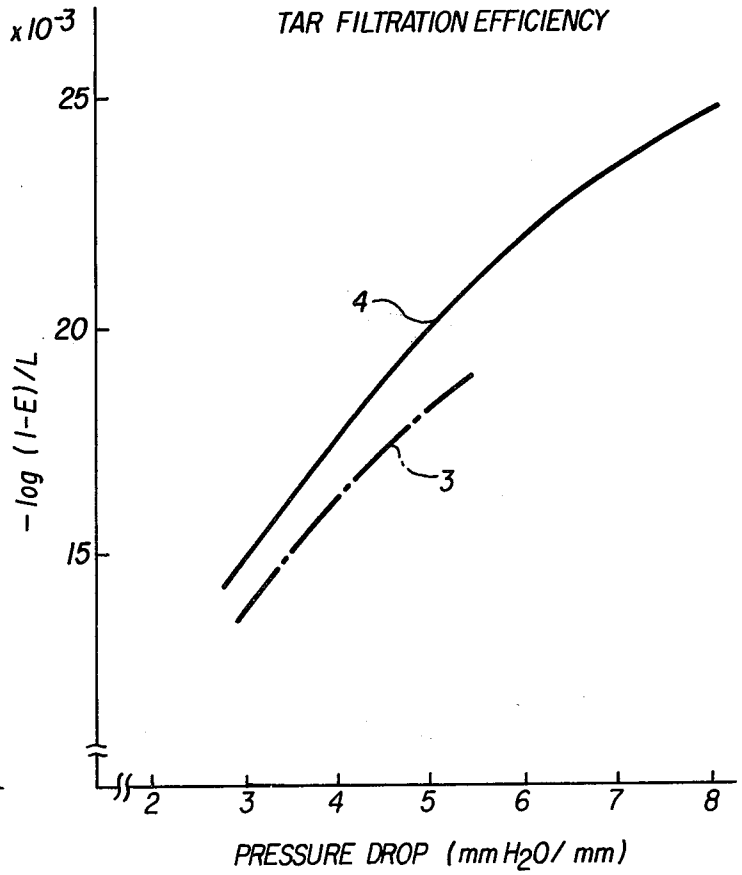
Figure 6:
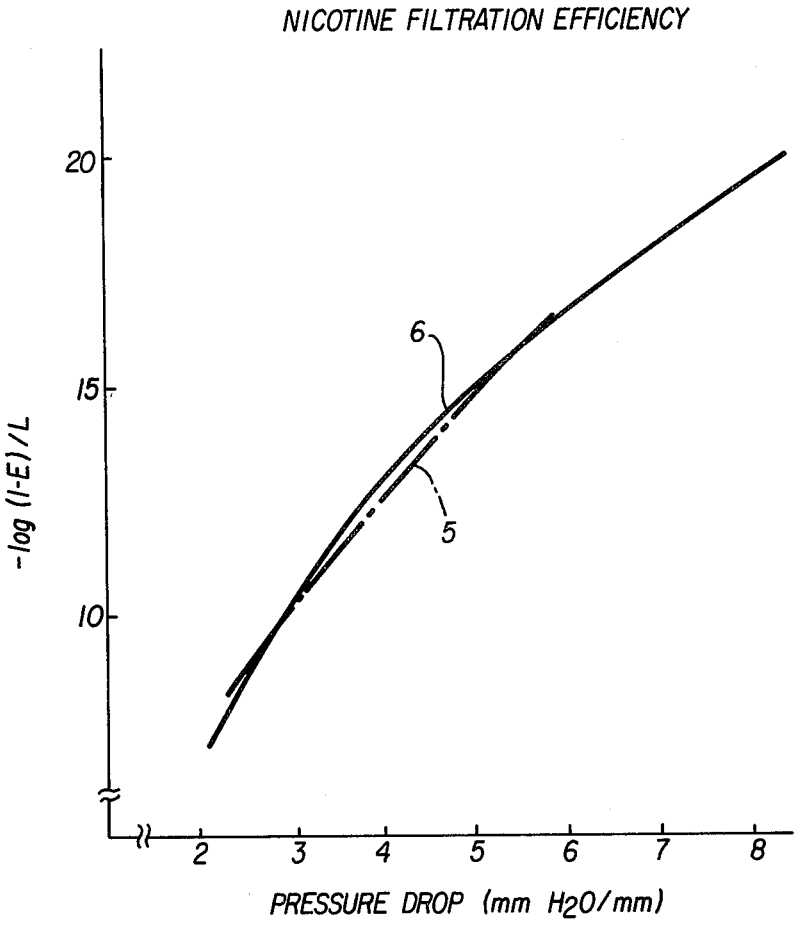
Figure 12:
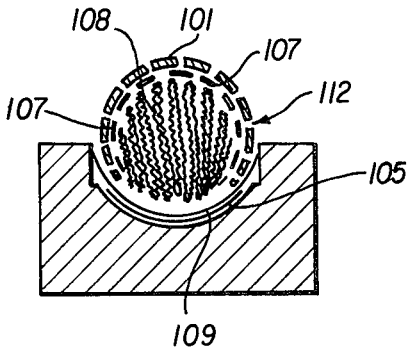
Figure 7:
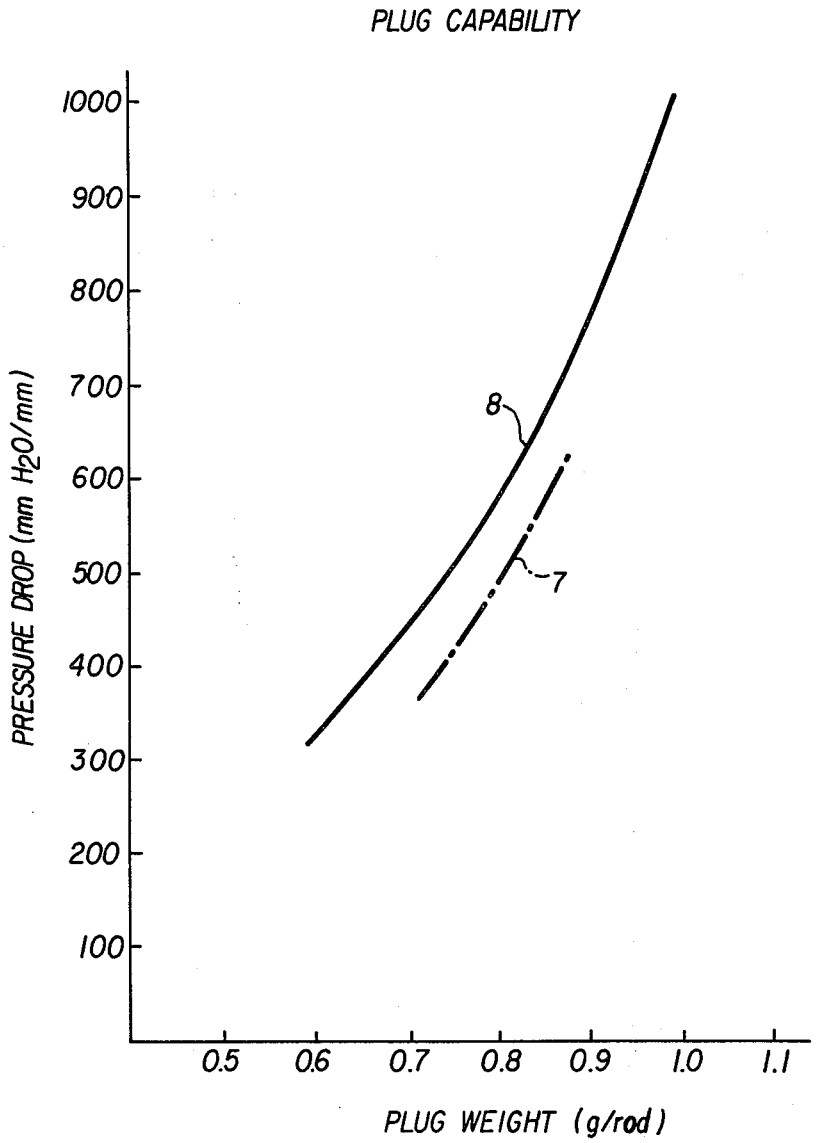
Figure 9:
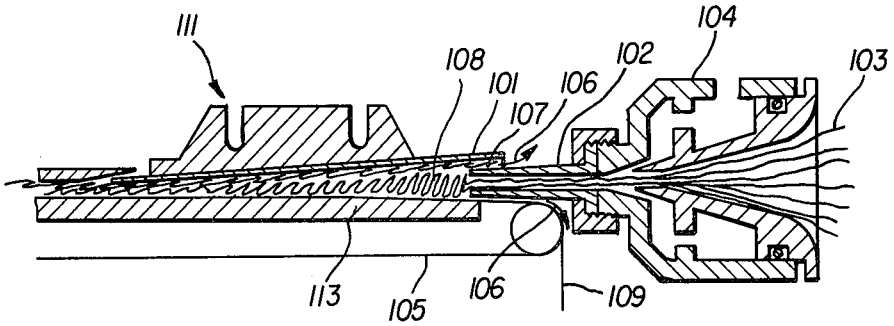
Figure 10:
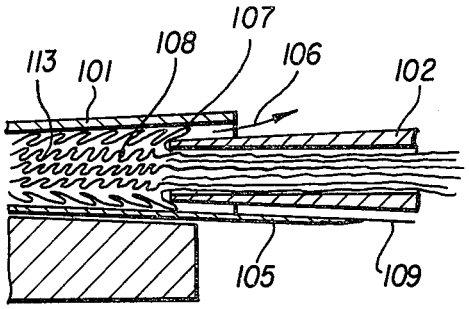
Figure 11:
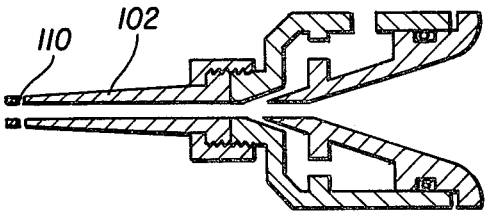

where: E is TPM filtration efficiency (%/100) and L is the length of the filter;

FIG. 5 is a graph showing tar filtration efficiencies, reference numeral 3 denotes a tar filtration efficiency of the prior art plain tobacco smoke filter, and reference numeral 4 denotes a tar filtration efficiency of the tobacco filter according to the present invention, the axis of abscissas representing a pressure drop per unit length of the filter and the axis of ordinates representing a filtration efficiency given by the above-noted equation (1);

FIG. 6 is a graph showing nicotine filtration efficiencies, reference numeral 5 denotes a nicotine filtration efficiency of the prior art plain tobacco smoke filter and reference numeral 6 denotes a nicotine filtration efficiency of the tobacco filter according to the present invention, the axis of abscissas representing a pressure drop per unit length of the filter whereas the axis of ordinates representing a filtration efficiency given by the above-noted equation (1);

FIG. 7 is a graph showing plug capability curve in which reference numeral 7 denotes a plug capability curve of the prior art plain tobacco filter while reference numeral 8 denotes a plug capability curve of the tobacco filter according to the present invention, the axis of abscissas representing plug weight per one filter, and the axis of ordinates representing a pressure drop;

FIG. 8 is a graph showing collapse resistance, i.e., plug hardness, in which reference numeral 9 denotes a plug hardness curve of the prior art plain tobacco filter while reference numeral 10 denotes a plug hardness curve of the tobacco smoke filter according to the present invention, the axis of ordinates representing plug weight and the axis of abscissas representing hardness;

FIG. 9 is a partial cross sectional view of the tobacco filter producing apparatus according to the present invention;

FIG. 10 is an enlarged longitudinal cross sectional view of the coupling part in which an air jet bill of the tobacco filter producing apparatus according to the present invention is inserted into the tongue portion;

FIG. 11 is a cross sectional view of the air jet means used in the present invention; and FIG. 12 is a partial transversal cross sectional view of the coupling part in which an end of the bill of the air jet means is inserted into the tongue portion of the plug machine, reference numeral 112 denoting a plurality of small holes.

DESCRIPTION OF THE PREFERRED EMBODIMENTS

The present invention concerns a tobacco filter plug in which a filter tow consisting of a number of filaments is formed into a cylindrical rod element which has an inner phase A consisting of fiber fillings in folding arrangement structure forming an angle of $\alpha$ with respect to the longitudinal axis of the plug in its longitudinal cross section, and which has an outer layer B, surrounding the outer circumferential periphery of the inner phase a more than approximately half round, consisting of fiber fillings in a folded structure substantially parallel to the longitudinal axis of the plug to thereby form a skin core fibrous structure.

Figure 1:
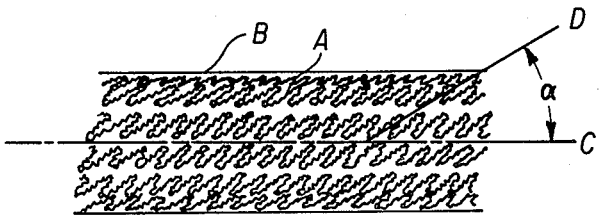
FIG. 1 is a longitudinal cross sectional view of a tobacco filter plug according to the present invention, A representing an inner core phase of filaments having folded arrangement structures, an angle $\alpha$ of the folding axis D, B an outer skin layer surrounding the inner phase and having holded structures, and C a longitudinal axis of the filter plug.

The fibrous arrangement structure of the tobacco filter plug according to the present invention has a particular cross section as shown in FIG. 1. FIG. 1 is a longitudinal cross sectional view showing the tobacco filter plug of the present invention, the cross section thereof accomodated with a cross section of the plug machine to be used for tobacco filter production. In case where the tobacco filter as in the present invention is produced using a wrapping paper according to the filter plug machine as disclosed in the aforementioned U.S. Pat. No. 3,016,945, the thus wrapping paper overlaps on the outer surface of the tobacco filter according to the present invention.

The inner phase according to the present invention, as mentioned above, consists of fibrous fillings arranged in the folded arrangement structure forming an angle of $\alpha$ to the longitudinal axis of the plug as generally indicated by A in FIG. 1. The folding angle $\alpha$ is not greater than 90°, preferably, 10° to 80° and most preferably, 20° to 70°.

Figure 2:
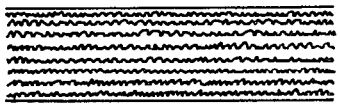
FIG. 2 is a longitudinal cross sectional view of a prior art plain type tobacco filter plug.
Figure 3:
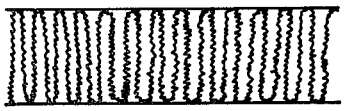
FIG. 3 is a longitudinal cross sectional view of a prior art tobacco filter having a fibrous structure in a folded structure vertical to the longitudinal axis of the plug.

A fibrous arrangement of the smoke filter heretofore developed is so called a plain filter type, in which high crimps fluffed on a number of filaments are parallel to the longitudinal axis of the plug as disclosed in U.S. Pat. No. 3,050,430. The longitudinal cross sectional view is schematically depicted in FIG. 2. It will be understood that the fibrous arrangement of the prior art is guite different from that intended by the present invention. The inner phase of the present invention is arranged in the following arrangement structure.

As compared with the plain type filter made of fiber's tow (2.2 Denier per Filament, Y-cross-section and 40,000 Denier), in the tobacco filter plug of fiber's tow (2.2 D/F, Y-cross-section and 25,000 T.D.) according to the present invention, tar filtration efficiency and TPM filtration efficiency are high whereas nicotine filtration efficiency is substantially the same as the prior art. As a result, a flavor tastable smoking is enjoyed and the removal efficiency of the harmful particles contained in the tobacco smoke is high according to the present invention. This relationship is graphically illustrated in FIGS. 4 to 6.

Figure 4:
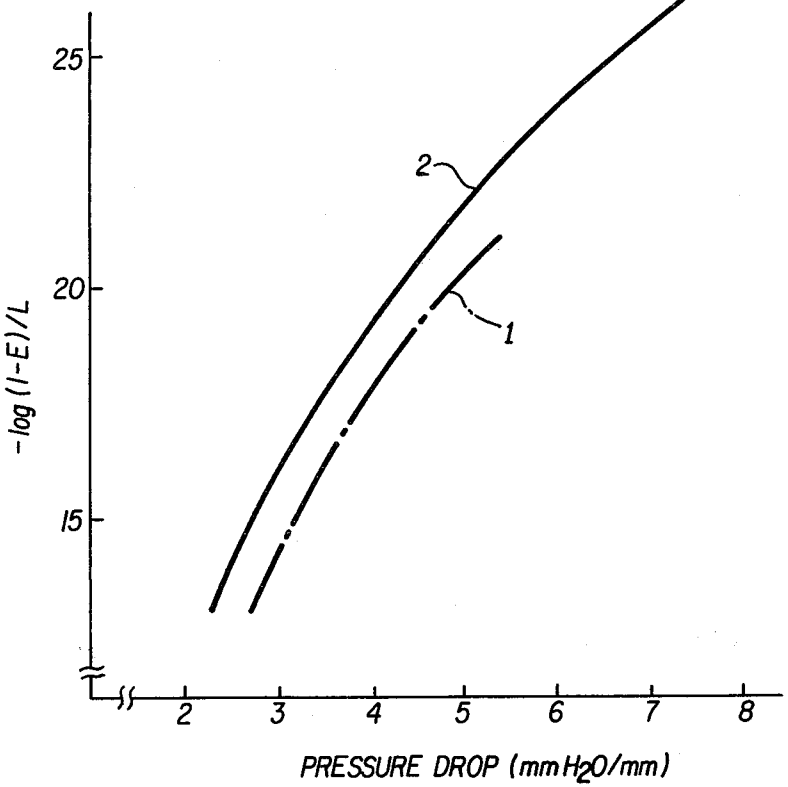
FIG. 4 is a graph showing TPM filtration efficiencies, where reference numeral 1 denotes a TPM filtration efficiency according to the plain type tobacco smoke filter, and reference numeral 2 denotes a TPM filtration efficiency according to the present tobacco smoke filter, the axis of abscissas representing a presssure drop per unit length of the filter and the axis of ordinates representing filtration efficiencies F given by the following equation.

FIG. 4 shows a graph of TPM filtration efficiencies of tobacco smoke filters. The TPM filtration efficiency of the prior art plain filter is represented by a dash and dot line 1 while the TPM filtration efficiency of the tobacco smoke filter according to the present invention is represented by a solid line 2. As is apparent from the graph, the ability of removing harmful TPM in the tobacco filter of the present invention is very high.

Similarly, FIG. 5 shows a graph of tar filtration efficiencies of tobacco smoke filters. The tar filtration efficiency of the prior art plain filter is represented by a dash and dot line 3 while the tar filtration efficiency of the tobacco smoke filter according to the present invention is reprented by a solid line 3. As is apparent from the graph, a better tar filtration efficiency can be obtained by the filter according to the present invention than the prior art filter.

FIG. 6 shows a graph of nicotine filtration efficiencies of tobacco smoke filters. The nicotine filtration efficiency of the tobacco filter according to the present invention is represented by solid line 6 and the nicotine filtration efficiency of the prior art plain filter is represented by a dash and dot line 5. It should be noted that the nicotine filtration efficiency according to the present invention is substantially the same as that of the prior art plain filter.

Accordingly, in the present invention, though the filtration efficiencies of TPM and tar are high, the nicotine filtration efficiency thereof is substantially the same as that of the prior art plain type tobacco smoke filter. The filter according to the present invention possesses such particular characteristics which are more suitable for a tobacco filter than the plain filter.

FIG. 7 is a graph showing test results of the pressure drop vs. plug weight which shows plug capability curve of tobacco filters according to the present invention and the prior art plain filter plug. The plug capability curve of the tobacco filter plug according to the present invention is represented by a solid line 8 and the plug capability curve of the tobacco filter plug of the prior art is represented by a dash and dot line 7. In FIG. 7, the filter plug according to the present invention, which has the same weight as the prior art plain filter has a relatively high pressure drop. As is apparent from the results, in the filter plug having the fibrous arrangement structure according to the present invention, the filtration efficiency thereof is enhanced in comparison with the prior art filter plug having the same weight.

In connection with this fact, it is possible to decrease the amount of fiber filaments to be used according to the filter plug of the present invention in comparison with the prior art filter plug having the same pressure drop. The following table shows this relationship as the "decreasing efficiency" of the fiber fillings in the filter plug.

TABLE 1

| | Total denier | | | |
|---|---|---|---|---|
| | prior art plain filter | tobacco filter of the present invention | | pressure drop of |
| D/F | 40,000–46,000 | 30,000 | 25,000 | mm $H_2O$ |
| 1.7 | 0 | 4.8% | 5.5% | 650 |
| 2.2 | 0 | 7.0% | 8.5% | 480 |
| 4.0 | 0 | 4.9% | 5.6% | 320 |

The "decreasing efficiencies" are obtained as follows:

$$T = \frac{X - Y}{X} \times 100$$

where X is the amount of fiber filaments of the plain filter and Y is the amount of fiber filaments of the present filter.

In order to effectively produce and utilize the tobacco filter plug according to the present invention, it will be understood that there are suitable ranges of the denier per one filament and total denier of the fibrous filaments to be used for the production thereof. Preferably, the total denier of the fiber to be used in the present invention is normally 5,000 D or more, and particularly 10,000 to 35,000 D. It is possible to obtain a tobacco filter plug having structure and characteristics as required for the present invention, by using the fibers selected from this particular range.

In general, if the fibers filled in the fiber plug forms fibrous structure in a folded arrangement structure having folding axes at an angle $\alpha$ of the axis of the filter plug, the filters tend to have particular characteristics as described above, which is preferable. In the meantime in order to enhance the collapse strength or resistance of the filter plug when the plug is held in the smoker's mouth, according to the present invention, there is provided an outer layer B composed of fillings of a number of filaments, folded in substantially parallel with the longitudinal axis of the filter plug to thereby form the fibrous arrangement structure surrounding the inner layer or phase A more than a half round thereof as can be seen in FIG. 1, whereby a sufficient strength may be offered to the filter plug.

It is not always required that the overall circumferential periphery of the inner layer A be completely surrounded by the outer layer B. It is sufficient that the outer layer B partially surrounds the outer periphery more than half round, preferably approximate 70% or more. As a result, sufficient strength and resistance against the bending may be given to the tobacco filter plug.

FIG. 8 is a graph showing hardness of the tobacco filter plug according to the present invention and the prior art plain tobacco smoke filter plug. A solid line represents the present tobacco plug and a dash and dot line represents the prior art tobacco filter plug. As is apparent from FIG. 8, the present filter plug is superior to the prior art plain filter plug in hardness and deformation resistance.

The tobacco filter plug according to the present invention is produced by using an apparatus in which an end of an improved air jet bill portion 102 is inserted into a tongue portion 101 of the well known filter plug machine. It is extremely effective that when the bill portion 102 of the air jet device is inserted into the tongue portion 101 of the plug machine, the filter plug machine is operated to thereby produce a tobacco filter plug. In the apparatus as disclosed in the above-described U.S. Pat. Nos. 3,016,945 and 3,050,403, the bill portion of the air jet means is not inserted in the tongue. In case where a tobacco filter plug is produced by using such an apparatus, it is difficult to produce a tobacco filter having a cross sectional view as shown in FIG. 1, even though the total denier number of fiber to be used for the filter plug is suitably selected or the pressure of gas to be supplied is varied appropriately.

When the tobacco filter plug satisfying the requirement of the present invention is produced, the apparatus in which it is possible to insert the end of the bill portion into the tongue may be used. It is desirable to produce filter plugs by using the improved air jet means in which a plurality of small holes 110 are formed in the outer periphery of the tapered bill end portion 102 as shown in FIG. 11. The number of the small holes is, preferably, 3 to 20.

By using the thus improved air jet means, the formation characteristics of the folding arrangement structure are further improved and the uniformity is also enhanced. Furthermore, in order to further enhance the above-described effects, a plurality of radial holes are formed in the outer tongue portion on at least one circumferential circle as shown in FIG. 12. Preferably, the small holes formed in the tongue are positioned nearby the tip end of the tapered portion of the air jet means.

Regenerated cellulose fibers such as viscose rayon, cuprammonium rayon or the like, cellulose ester fiber such as cellulose diacetate, cellulose triacetate or the like and polyolefin fiber such as polypropylene fiber may be used as fillings for the present tobacco filter.

Referring now to FIG. 9, the producing process of the tobacco filter plug according to the present invention will be described.

The diacetate fiber tow having 2.2 D/F, 25,000 T.D. and Y-cross-section is opened up and sprayed with glyceryl triacetate. As the opened-up tow 103 is converged, it passes through the air jet means 104, and inserted into the space defined in the tongue 101 and the garniture tape 105 to form a bundle of filaments 108 which is folded in the crosswise or transversal direction with respect to the central axis by overfeeding. The overfeeding rate is, desirably, 1.2 or more times of the plug manufacturing speed.

The outer peripheral portion of the fiber bandle folded in the transversal direction is partially extruded rearwardly as indicated by 107 through the tip end portion of the air jet means and/or the small holes formed around the tip end portion due to the fact that the compressed air supplied from the air jet means to the tongue portion escapes in the direction as designated by the arrow 106, and then the partially extruded part of the fibrous bundle is again retracted into the plug machine to thereby form the outer layer B required for the invention.

Sheering stress is then applied to the outer surface of the fibrous bundle 108 folded in the transversal direction by the garniture tape 105 which travels inside of the tongue 101, so that the folded fiber inclines to form the inner phase 113 having a slant angle of $\alpha$ as shown in FIG. 10.

In case a plug paper 109 is provided around the outer periphery of the thus produced filter plug consisting of two different kind core layers in fibrous arrangement structure to thereby complete the filter plug of the invention. In this case, it is possible to use a corrugated synthetic resin paper and it is also possible to use a porous wrapping paper other than a normal wrapping paper.

FIG. 10 is an enlarged cross-sectional view of the part in which the bill end of the air jet means is inserted into the inner end of the tongue as shown in FIG. 9.

The tobacco filter plug according to the present invention has the quite different fibrous arrangement structure from that of the prior art plain filter plug, providing the following advantages over the prior art.

(a) In spite of the small amount of fiber tow, the present filter enables to provide a sufficient pressure drop against the tobacco smoke passage therethrough.

(b) The removable efficiencies of TPM and tar contained in the tobacco smoke, which are harmful on the health are high.

(c) The removal efficiency of nicotine contained in the tobacco smoke is maintained at substantially the same level as the prior art so that the flavor tastable characteristics remain.

(d) The collapse resistance of the filter when the filter is held in the smoker's mouth is high and a good feeling can be obtained.

Two examples will be described in detail for readily understanding the present invention.

The hardness and the pressure drop of the filter plug were measured as follows.

Hardness

Static weight of 300 g was applied to the upper circular cross section of the plug and this state was maintained for 20 seconds. Then, the deformation was measured in order of 1/10 mm unit.

Pressure Drop

When the air was inspirated so that the amount of the air passing through the plug become 17.5 ml/sec, the water head scale of the manometer was measured.

EXAMPLE 1

Air jet means having a cross section as shown in FIG. 11 and having a tapered bill nozzle 102 provided with eight small holes 110 of 1.0 mm in diameter at its end was used. Such air jet means was mounted on the filter producing plug machine 111 so that the end of the tapered bill nozzle was inserted into the space defined by the tongue 101 and the garniture tape 105.

A finer fiber tow 103 of 2.2 D/F, Y-cross-section and 30,000 T.D. was opened up, and sprayed with glyceryl triacetate (6%), and converged by the air jet means 104, and then filled into the space in the tongue portion 101 so that the diacetate tow was folded in crosswise manner as indicated by 108. The outer part of the folded fibrous bundle 108 was drawn backward of the plug machine from the tip end of the tapered nozzle. The compression air was supplied to the air jet means at 1.7 $kg/cm^2G$.

The garniture tape 105 was moved at the filter manufacturing speed of 200 m/min with the diacetate fibrous tow filled into the tongue, and at the same time a wrapping paper 109 was supplied and wrapped thereon to thereby complete a tobacco filter (I) having a circumferential length 24.7 mm and a longitudinal length of 120 mm.

Another diacetate fibrous tow of 2.2 D/F, Y-cross-section, and 25,000 T.D. was used to produce another tobacco filter (II) in the same manner. The final product had substantially the same dimensions or sizes.

For comparison, a diacetate fibrous tow of 2.2 D/F, Y-cross-section, and 40,000 T.D. was used to produce a filter plug (III) by employing the air jet means as disclosed in the U.S. Pat. No. 3,050,430. The final filter (III) had a circumferential length of 24.7 mm and a longitudinal length of 120 mm.

The pressure drop was approximate 480 mm in any filter. Weights per one plug filter and hardness were measured in the following table 2.

TABLE 2

| measurement items | kinds of filters: filter of the present invention, filter (I) | filter of the present invention, filter (II) | prior art filter, filter (III) |
|---|---|---|---|
| the amount of tow used for one filter (g/one filter) | 0.66 | 0.65 | 0.70 |
| hardness | | | |

TABLE 2-continued

| measurement items | kinds of filters: filter of the present invention filter (I) | filter of the present invention filter (II) | prior art filter filter (III) |
|---|---|---|---|
| in unit 1/10 mm | 7.4 | 7.3 | 8.7 |

As is apparent from the results, in spite of the fact that the amount of the fiber consumed in the filter according to the present invention is decreased by approximate 8.5% in comparison with the prior art filter, the collapse resistance in its transversal direction of the filter according to the present invention was enhanced more than approximate 16%. It should be noted that the tobacco filters (I) and (II) of the present invention had cross sections as shown in FIG. 1 whereas the tobacco filter III of the prior art had a cross section as shown in FIG. 2.

Table 3 shows the test results, in which the tobacco filters (I), (II) and (III) were cut length of 20 mm in the known manner, and the cut filters were, respectively, attached to the cigarettes sold on the market, and were smoked under the condition of a flow rate of smoke of 17.5 ml/sec, a smoke cycle of a puff time period of two seconds and a puff interval time period of fifty-eight seconds, and a burning length of 50 mm, using a constant-flow type automatic smoking machine, and the smokes were collected by using the "Cambridge" filter, and then TPM filtration efficiency, tar filtration efficiency, and nicotine filtration efficiency were measured.

TABLE 3

| measurement items | kinds of filters: filters of the present invention filter (I) | filters of the present invention filter (II) | prior art filter filter (III) |
|---|---|---|---|
| pressure drop (mm $H_2O$) | 80 | 80 | 80 |
| TPM filtration efficiency (%) | 58.5 | 58.9 | 56.1 |
| tar filtration efficiency (%) | 54.0 | 55.5 | 53.0 |
| nicotine filtration efficiency (%) | 43.5 | 43.6 | 44.0 |
| folding angle | about 40° | about 30° | 0° |

It may be seen that the filtration efficiencies of TPM and tar which are harmful components contained in the tobacco smoke are high in the filters (I) and (II) of the present invention in comparison the filter (III) of the prior art whereas the filtration efficiency of nicotine which is a flavor tastable component is not increased in the filters (I) and (II) as compared with the prior art filter (III). It is testified that the filter according to the present invention offer good flavor tast.

EXAMPLE 2

A diacetate fibrous tow of 4 D/F, Y-cross-section, and 30,000 T.D. was used to produce a tobacco filter (IV) in the same manner as in EXAMPLE 1.

A diacetate fibrous tow of 4 D/F, Y-cross-section, and 25,000 T.D. was used to produce a tobacco filter (V) in the same manner.

A diacetate fibrous tow of 4 D/F, Y-cross-section, and 43,000 T.D. was used to produce a plain-type tobacco filter (VI).

The tobacco filters (IV) and (V) had cross sections as shown in FIG. 1 while the filter VI had a cross section as shown in FIG. 2.

The hardness and the weight of the filters (IV), (V) and (VI) were measured at the pressure drop of 320 mm $H_2O$ as follows.

TABLE 4

| measurement items | kinds of filters: filters of the present invention filter IV | filters of the present invention filter V | prior art filter filter VI |
|---|---|---|---|
| the amount of the fiber used for one filter (g/one filter) | 0.69 | 0.68 | 0.72 |
| hardness (1/10 mm) | 6.3 | 6.2 | 8.3 |

The above-described tobacco filters (IV), (V) and (VI) each having a length of 17 mm and a pressure drop of 45 mm $H_2O$ were coupled to the tobacco cylinder as used in the EXAMPLE 1. The filter characteristics thereof were measured in the same manner as in EXAMPLE 1.

The results are shown in Table 5.

TABLE 5

| measurement items | kinds of filters: filters of the present invention filter IV | filters of the present invention filter V | prior art filter filter VI |
|---|---|---|---|
| pressure drop (mm $H_2O$) | 45 | 45 | 45 |
| TPM filtration efficiency (%) | 41.4 | 43.3 | 38.3 |
| tar filtration efficiency (%) | 36.5 | 37.6 | 36.0 |
| nicotine filtration efficiency (%) | 28.3 | 26.9 | 28.3 |
| folding angle | about 35° | about 28° | 0° |

From the results shown in Table 5, it may be seen that according to the present invention, TPM and tar filtration efficiencies are high and the nicotine filtration efficiency is maintained not to decrease, thereby providing a flavor taste and good feeling when the filter is held in the smoker's mouth.

What is claimed is:

1. A tobacco smoke filter plug comprising fiber tow fillings in the form of cylinder, composed of an inner core phase A and an outer skin layer B different from each other in fibrous arrangement structure thereof, said inner core phase A being consisting of fillings in a folded arrangement structure having a folding axis forming an angle of $\alpha$ with respect to the central longitudinal axis of the filter plug in cross section, and said outer skin layer B being consisting of fillings in a folded structure substantially parallel to the central longitudinal axis of the filter plug in cross section and surrounding said inner core phase.

2. A tobacco smoke filter plug as defined in claim 1, wherein said outer layer B surrounds said inner core phase A more than 70% of the circumference of the filter plug.

3. A tobacco smoke filter plug as defined in claim 1, wherein an angle $\alpha$ of the folding axis is not greater than 90°.

4. A tobacco smoke filter plug as defined in claim 1, wherein the angle $\alpha$ of the folding axis is approximate 10° to 80°.

5. A tobacco smoke filter plug as defined in claim 1, wherein the angle $\alpha$ of the folding axis is approximate 20° to 70°.

6. A tobacco smoke filter plug as defined in any of the preceding claims, wherein the fibrous fillings are made of a tow having 1.0 to 4.0 D/F and 5,000 to 35,000 T.D.

7. A tobacco smoke filter plug as defined in claim 6, wherein the fibrous fillings are made of at least one material selected from the group of regenerated cellulose fiber, polyolefine fiber, and cellulose ester fiber.

8. A tobacco smoke filter plug as defined in claim 6, wherein the fibrous fillings are made of a tow of cellulose diacetate fiber.

* * * * *

UNITED STATES PATENT AND TRADEMARK OFFICE

CERTIFICATE OF CORRECTION

PATENT NO. : 4,316,475

DATED : February 23, 1982

INVENTOR(S) : TAKASHI SAKAI ET AL

It is certified that error appears in the above-identified patent and that said Letters Patent is hereby corrected as shown below:

Correct Figure 1 to read as follows:

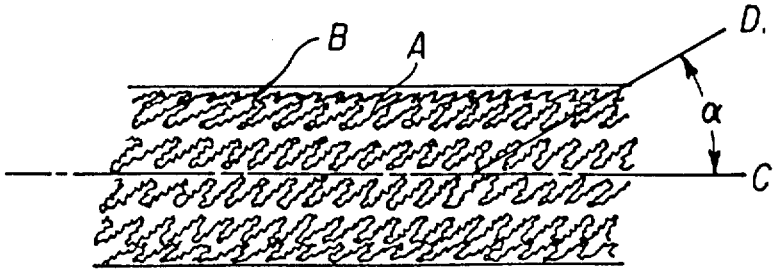

FIG. 1

Figure 4, add title as follows:

--TPM Filtration Efficiency--.

Signed and Sealed this

Twenty-fifth Day of January 1983

(SEAL)

Attest:

GERALD J. MOSSINGHOFF

Attesting Officer

Commissioner of Patents and Trademarks